US005911598A

United States Patent [19]

Pawlenko

[11] Patent Number: 5,911,598

[45] Date of Patent: Jun. 15, 1999

[54] ELECTRICAL CONNECTOR WITH PROTECTIVE GEL

[75] Inventor: Ivan Pawlenko, Holland, Pa.

[73] Assignee: Lucent Technologies, Inc., Murray Hill, N.J.

[21] Appl. No.: 08/997,847

[22] Filed: Dec. 24, 1997

[51] Int. Cl.[6] ..... H01R 9/09

[52] U.S. Cl. ..... 439/521; 439/676

[58] Field of Search ..... 439/676, 675, 439/660, 201, 204, 521, 936; 29/855

[56] References Cited

U.S. PATENT DOCUMENTS 4,556,264 12/1985 Tanaka ..... 439/62

*Primary Examiner*—Steven L. Stephan
*Assistant Examiner*—Michael C. Zarroli
*Attorney, Agent, or Firm*—Michael Y. Epstein; Henry I. Schanzer

[57] ABSTRACT

A connector assembly for telephone wires comprises an open-ended tubular receptacle telescoped within a tubular member having a closed bottom. Wires extend through a port in the tubular member, upwardly along a receptacle side and project angular inwardly and downwardly of the receptacle. A low viscosity curable sealant fluid is poured into the assembly while in tilted orientation for submerging the wires within the receptacle while not filling the receptacle (for reducing the amount of fluid required while disposing the upper surface of the sealant fluid pool below the level of the wire receiving point of the tubular member for preventing gravity escape of the sealant fluid until the fluid sets up for self-retention within the receptacle.

6 Claims, 5 Drawing Sheets

ELECTRICAL CONNECTOR WITH PROTECTIVE GEL

BACKGROUND OF THE INVENTION

This invention relates to electrical connectors, and particularly to electrical connectors used for interconnecting data conveying wires, e.g., telephone data.

A commonly used telephone connector plug comprises a solid block of plastic which has embedded therein wire terminating metal plates having exposed terminal edges. The plug snap fits into a receptacle for electrically engaging the plug terminal edges with corresponding terminal edges exposed within the receptacle. In one connector assembly, a plurality of connector receptacles are disposed side-by-side on a common "bottom" plate (with the connector assembly horizontally oriented) with the receptacles opening upwardly. Wires enter the connector receptacles through bottom openings thereof, and terminals of the wires are fixedly positioned along a side wall of the receptacle cavities.

For protecting the exposed wire terminals within the receptacles against oxidation and other contaminants, one practice is to coat the otherwise exposed terminals with a known sealant material, e.g., a lubricating jelly or a high viscosity silicone gel. When a connector plug is snap fitted into a receptacle, the sealant is squeezed out from between the contacting terminals for obtaining good electrical contacting.

A preferred sealant is the aforementioned silicone gel which is conveniently storable for prolonged periods in the form of two chemically inactive components which, when mixed together, rapidly set-up or cure into a high viscosity gel. Most conveniently, the two gel components are simultaneously poured into the connector receptacles and allowed to set-up therewithin. A problem, however, is that while the resulting gel is of high viscosity and tends to stay within the receptacle adhered to the terminals and receptacle side walls, the components that make up the gel are of low viscosity and would flow outwardly through the receptacle wire receiving bottom openings. The undesirable flow of sealant components through the bottom opening is prevented by sealing the receptacle bottom openings with tape or adhesive foam or the like. The sealing of the bottom opening is generally satisfactory except that the sealing process is expensive because it is time consuming and requires extra sealing materials.

Another problem, also relating to cost, is that until the plugs are inserted into the receptacles, a relatively large open space is present. In order to completely coat the exposed wire terminals, which extend vertically along the walls of the receptacle cavities, the cavities are completely filled with the gel components. Such components are relatively expensive. The gel components fully cover the terminals and, after curing, effectively encapsulate them. But such encapsulation requires only a relatively thin coating, hence most of the cured gel within the receptacle cavity serves no useful purpose and is basically wasted.

SUMMARY OF THE INVENTION

A connector assembly includes an open-ended connector receptacle telescoped within a hollow tubular member having "vertically" extending (with the assembly horizontally disposed) side walls and a closed bottom end. Wires to be terminated within a cavity within the receptacle enter the tubular member through a side wall, extend upwardly along a side wall of the receptacle, and extend from the side wall into the receptacle cavity in parallel directions angled away from the side wall and towards the bottom open end of the receptacle.

For pouring a fluid sealant into the receptacle, the connector assembly is tilted for disposing the otherwise downwardly extending receptacle wires in horizontal orientation. The tilted receptacle is filled with the sealant fluid to a proper depth such that the exposed wires are fully submerged. The pool surface extends diagonally across the receptacle cavity, hence only partially filling the cavity and reducing the amount of sealant needed. Also, in the tilted orientation of the tubular member, the tubular member side wall opening through which the receptacle wires enter the tubular member is disposed above the surface of the sealant fluid for preventing leakage of the fluid. The connector assembly is retained tilted until set-up of the sealant, after which leakage of the sealant is prevented due to the high viscosity of the sealant.

DESCRIPTION OF THE DRAWINGS

The drawings are schematic and not to scale.

DESCRIPTION OF PREFERRED EMBODIMENTS OF THE INVENTION

Figure 3:
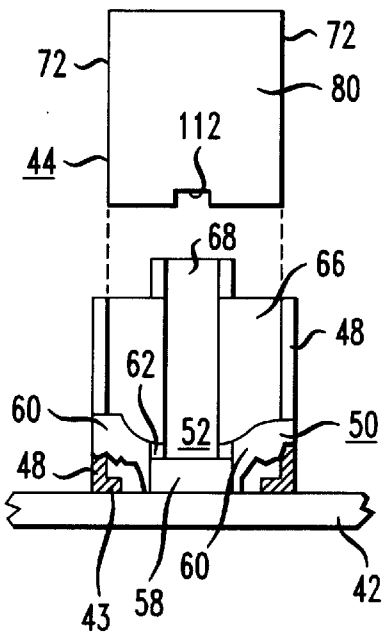
FIG. 3 is a view similar to FIG. 2, also partly broken away (but, for clarity, omitting a wire shown in FIG. 2), looking from right to left in FIG. 2, and showing a gap through a wall of the tubular member portion.
Figure 2:
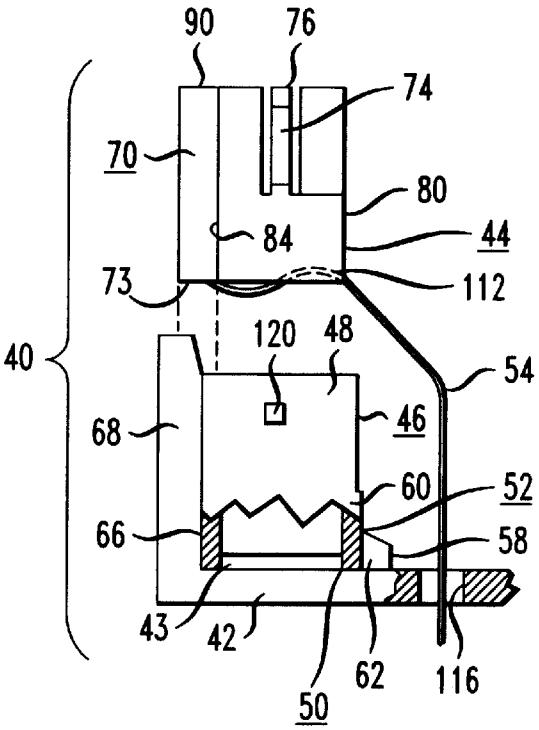
FIG. 2 is a side elevation, partly broken away, of a two-part connector assembly according to the present invention with a connector receptacle portion of the inventive assembly shown in the process of being inserted into a tubular member portion of the connector assembly.
Figure 1:
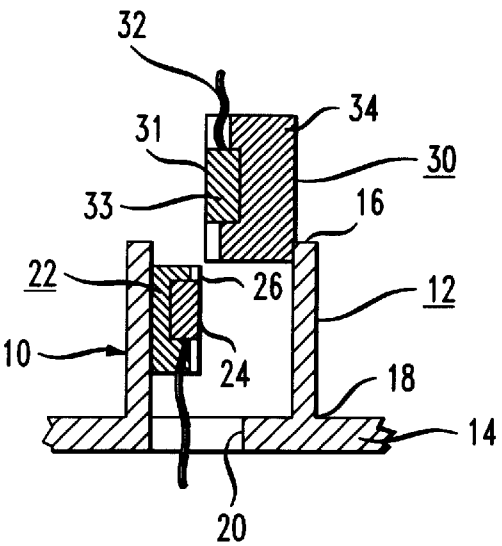
FIG. 1 is a side sectional view of a portion of a prior art connector assembly and showing a connector plug in the process of being inserted downwardly into the cavity of a connector receptacle portion of the connector assembly.

FIG. 1 shows a small portion of a prior art connector assembly 10 including a connector receptacle 12 integrally formed on a bottom plate 14. The receptacle 12 can be but one of a plurality of identical receptacles (not shown) mounted in side-by-side relation on the plate 14. Preferably, the plate 14 and the several receptacles thereon are injection molded as a single piece, e.g., of a plastic material. The connector receptacle 12 is open at the top 16 and partially open at the bottom 18 with the bottom opening 20 comprising an opening through the plate 14 for the admission of a connector module 22. The module 22 is of known type and comprises a solid block of plastic material having embedded therewithin a number of flat terminal plates having edges 24 exposed at a surface 26 of the module. The module 22 fits tightly within the receptacle 12 against an inside wall thereof, and the module exposed terminal edges 24 are exposed within the cavity of the receptacle.

Electrical connections to the receptacle terminal edges 24 are by means of a plug 30 inserted into the receptacle through the open upper end 16 thereof. The plug 30 is similar to the connector module 22 in that it includes exposed edges 31 of terminal plates 33 attached within a molded plastic block 34, the terminal plates being attached to the ends of wires 32 extending from the plug 30. Typically, the plug 30 includes a cantilevered spring leaf plate (not shown) serving as a means for securely snap fitting the plug 30 within the connector receptacle 12.

As previously described, the receptacle cavity is filled with sealant components which cure into a gel to encapsulate and protect the exposed receptacle terminals 24 and, to this end, prior to the pouring of the sealant components into the receptacle, the bottom opening 20 is sealed, e.g., with tape or adhesive foam (not shown in FIG. 1). This sealing step is avoided according to the present invention.

A connector assembly 40 according to the present invention is shown in FIGS. 2 through 9. Similarly, as with the previously described known connector assembly 10, the inventive assembly includes a "bottom" plate 42 (in the orientation shown in FIG. 2) on which a plurality of connector receptacles are mounted. Only a single such receptacle 44 is illustrated herein. The inventive assembly 40 differs from the known assembly in that, among other things, a connector plug receiving receptacle 44 is not mounted directly on the bottom plate 42, but is received within a tubular member 46 integral with the bottom plate 42 and having a closed bottom wall provided by the plate 42.

Figure 3A:
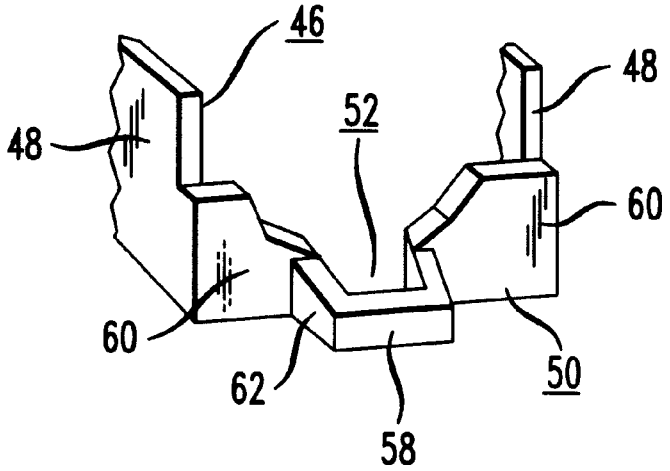
FIG. 3A is a view, in perspective, of the gapped wall of the tubular member portion shown in FIG. 3.
Figure 4:
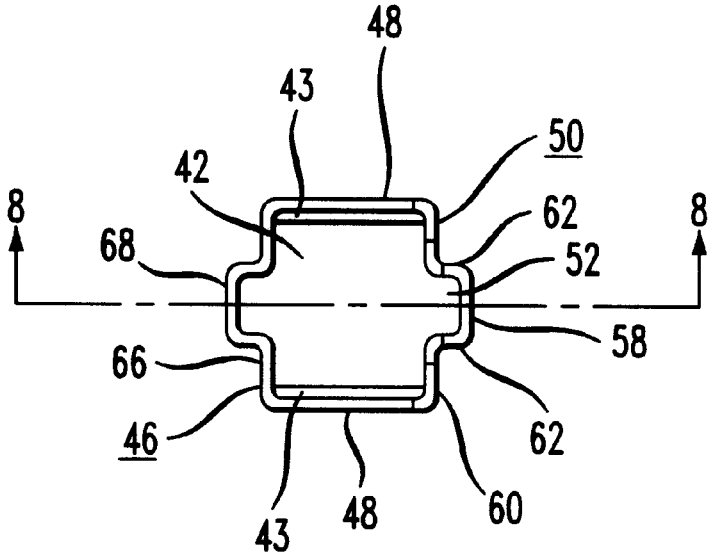
FIGS. 4 and 5 are respective plan views of the tubular member portion and the connector receptacle shown in FIG. 2.

Referring to FIG. 4, the tubular member 46 has four vertically extending walls including two oppositely disposed walls 48 which are substantially identical. A multi-portion third wall 50, joining the two oppositely disposed walls 48, is of reduced height (FIGS. 3 and 3A) relative to the walls 48 and provides an exit gap 52 for wires extending from terminals (to be described) exposed within the connector receptacle 44. The gap 52 is defined by the aforementioned third wall section 58 spaced from and parallel to portions 60 of the wall 50 on either side of the gap 52. The wall section 58 is of shorter height than the wall portions 60 and is connected thereto by transverse wall segments 62.

Figure 8:
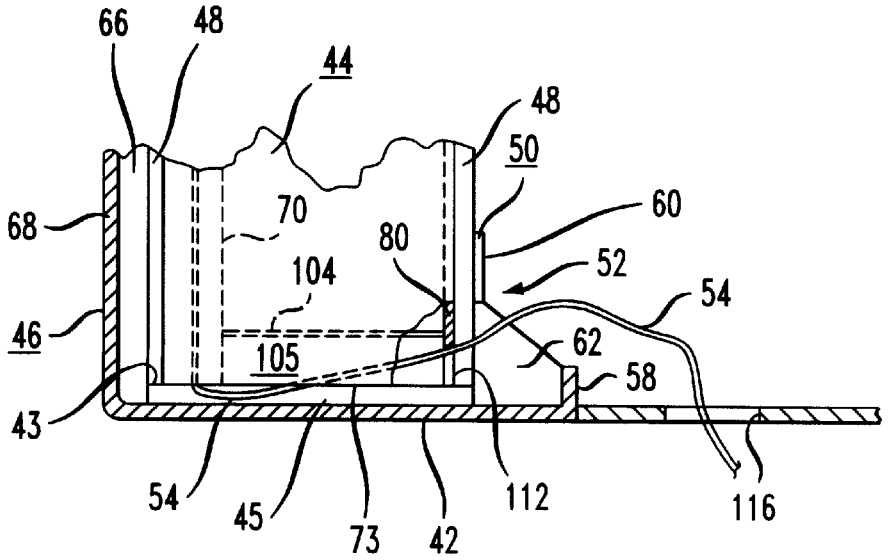
FIG. 8 is a side sectional view of the lower portion of an assembled together connector assembly according to the present invention and along a section corresponding to line 8-8 of FIG. 4 (showing only the tubular member)

The fourth wall 66 of the tubular member 46 includes (FIG. 4) a U-shaped channel portion 68 positioned midway of the wall 66 and having a height (FIGS. 2 and 3) greater than the portions of the wall 66 on either side of the channel portion 68. As described hereinafter, the channel portion 68 snugly receives a correspondingly shaped section 70 (FIG. 5) of the receptacle 44 and serves to guide the receptacle 44 into place during insertion of the receptacle 44 into the tubular member 46. When the receptacle 44 is disposed within the tubular member 46, as described hereinafter, it is preferable to provide a space between the bottom of the receptacle and the bottom surface of the tubular member bottom wall 42. To this end, two ridges 43 (FIG. 3) extending upwardly from the bottom wall 42 are provided which also extend parallel to-and adjacent to the tubular member side walls 48. As shown in FIG. 8, the receptacle 44 rests on the spaced apart ridges 43, and a space 45 is provided between the bottom of the receptacle 44 and the bottom wall 42 of the tubular member 46.

The inventive connector receptacle 44 is preferably not an integral part of the remainder of the connector assembly 40 but is a separate part assembled onto the connector assembly. The receptacle 44 is an open-ended tubular member of a cross-section (FIG. 5) comparable to that of the cavity (FIG. 4) within the tubular member 46. The receptacle 44 includes four vertically extending walls including a pair of oppositely disposed and substantially identical walls 72. Each of the walls 72 includes a vertically extending leaf spring 74 (see, also, FIG. 2) having a latch 76 adjacent to the upper end of the spring 74. The latched spring 74 is a known means for snap-fitting (i.e., locking) telescoping parts, in the present embodiment, the receptacle 44 within the tubular member 46.

The two walls 72 (FIG. 5) are joined by a third wall 80 having an interior configuration for mating with a known connector plug (e.g., identical to the plug 30 shown in FIG. 1).

Figure 6:
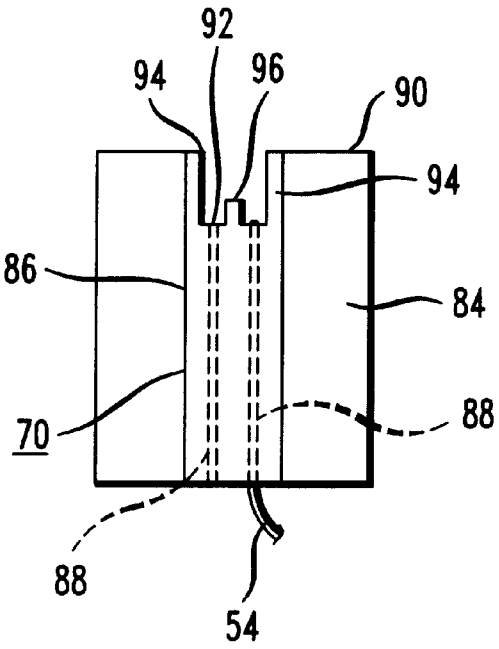
FIG. 6 is a side elevation of the connector receptacle shown in FIG. 2 and looking from right to left in FIG. 2.
Figure 5:
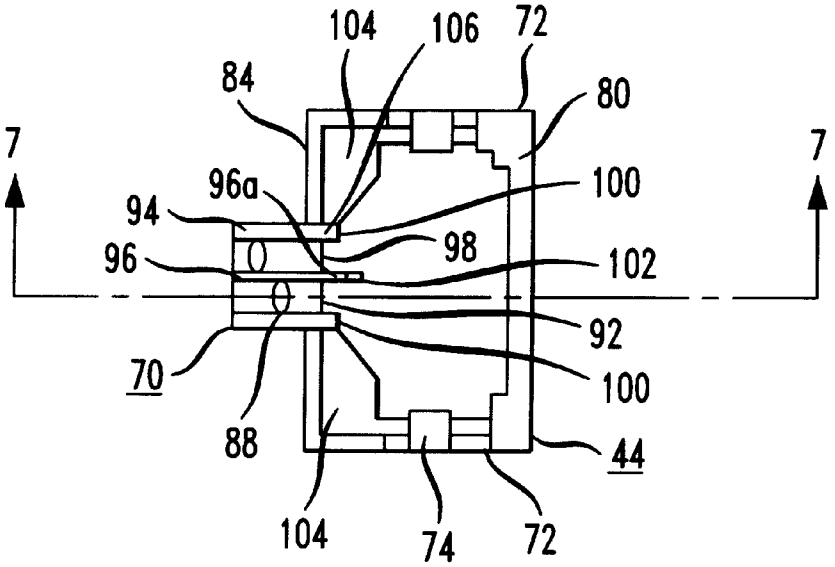
Figure 7:
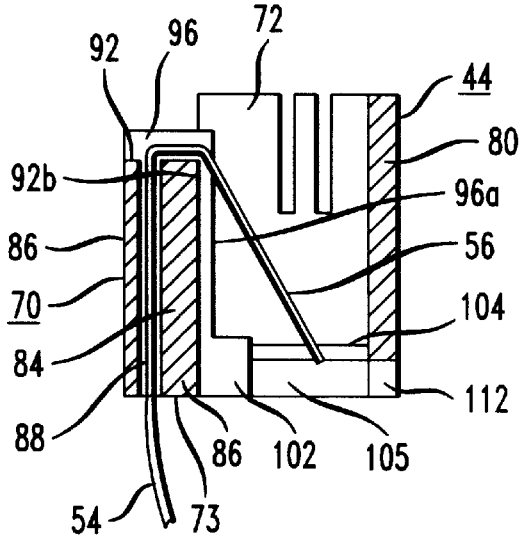
FIG. 7 is a side section of the connector receptacle taken along the line 7—7 of FIG. 5 and showing, additionally, a wire terminal within the cavity of the connector assembly.

The fourth wall 84 (FIG. 5) includes a laterally extending (the aforementioned) section 70 which fits within the channel portion 68 (FIG. 4) of the tubular member 46. The bottom portion 86 of the section 70 (FIGS. 6 and 7) is solid except for two (in this embodiment) vertically extending passageways 88 for receipt of two wires 54. (One of the two wires present is shown in FIGS., 2, 6, 7, 8 and 9. For greater clarity, the wires 54 are not shown in the other figures.) Referring to FIG. 6, the solid portion 86 ends below the upper end 90 of the section 70 and provides a horizontal shelf 92 into which the two passageways 88 open. The wall section 70 extends vertically above the shelf 92 in the form of two spaced apart wall extensions 94. On the shelf 92 itself, a low wall 96 divides the shelf 92 into two channels each associated with a respective passageway 88. As described hereinafter, stiff terminal wires 56 (FIG. 7) are secured to ends of the wires 54 disposed within the passageways 88, and the terminals 56 exit onto the shelf 92 and extend therealong in separate channels for preventing contacting and shorting of the terminals 56.

The inside surface 98 (FIGS. 5 and 7) of the fourth wall 84 is also shaped to provide two vertically extending interior channels which (FIG. 5) are extensions of the channels on the horizontal shelf 92. these vertical channels are defined by three parallel vertical ridges including a middle ridge 96*a* and two outside ridges 100. The middle ridge 96*a* is an extension of the shelf (92) dividing wall 96. The two interior channels extend almost entirely to the bottom of the receptacle for maintaining separation of the two wires 56. As shortly to be described, the wire terminals 56 within the receptacle cavity project angularly away from the side wall 84 and are of increasing distance from the cavity side wall 84 towards the receptacle bottom end. In conformity with such increasing distance, the middle ridge 96*a* of the wire separating interior channels includes a portion 102 of increased height relative to the side wall 84. The outer ridges 100 remain of constant height, but are interconnected by a pair of horizontal plates 104 having (FIG. 5) a V-gap 106 therebetween. The enlarged height portion 102 of the middle ridge 96*a* passes through the V-gap 106 and provides, in combination therewith, portions of the two interior channels near the bottom of the receptacle having walls of sufficient height (relative to the receptacle wall 84) for maintaining the two wire terminals 56 separate from one another. The two horizontal plates 104 are spaced slightly above (FIGS. 7 and 8) the bottom end 73 of the receptacle and form a horizontal shelf near the receptacle bottom 73 which defines an open space 105 within the receptacle 44 directly beneath the shelf plates 104. As described hereinafter, a connector plug 30, such as shown in FIG. 1, is snap-fitted into the receptacle and rests on the horizontal shelf 104.

As mentioned, two wires 54 (FIG. 7) extend through the two vertical passageways 88 through the wall section 70 of the receptacle 44. The wires 54 are insulated, but ends of the wires within the passageways are rigidly crimped to the aforementioned stiff wire terminals 56 which extend into the receptacle 44. Preferably, the wires 54 are first crimped to elongated and straight terminal wires which are then threaded into the passageways 88 from the bottom ends thereof until the crimped joint between the respective pairs of wires 54 and 56 engage a stop (not shown) within the passageways with the terminal wires 56 projecting axially from the passageways 88. The extending ends of the wires 56 are then bent and formed to the shape shown.

The two terminals 56 thus comprise two relatively stiff cantilevered wire springs pivotable about the inner edge 92*b* (FIG. 7) of the horizontal shelf 92. As previously noted, the two terminals 56 extend laterally outwardly in a downward direction and along parallel directions which, if extended, intersect the bottom surface of the receptacle. The terminals 56 pass through the V-gap 106 (FIG. 5) between the receptacle horizontal plates 104 and on either side of the enlarged height portion 102 of the middle ridge 96*a* of the receptacle interior channels and end just below the plates 56.

The two parallel terminals 56 within the receptacle 44 define a plane tilted relative to the vertical direction. The plane of the terminals 56 can thus be rotated relative to the vertical axis for horizontal disposition, as hereinafter described.

As mentioned, the terminals 56 within the receptacle cavity are extensions of wires 54 (FIG. 7) which enter into passageways 88 through the wall section 70 of the receptacle 44. The wires 54 enter into the section through the lower end 73 thereof and, exteriorly of the wall section 70, the wires pass directly beneath the receptacle open bottom end 73. Conveniently, a small slot or gap 112 is provided at the bottom of the receptacle wall 80 through which the wires 54 can pass.

When the receptacle 44 is within (FIG. 8) the tubular member 46, the wires 54 exit through the gap 112 of the receptacle bottom wall 80 and pass through the previously described gap 52 through the wall 50 of the tubular member 46. As described, the gap 52 is defined by a low wall section 58 laterally spaced from other portions 60 of the wall 50. This spacing provides a path for the wires 54 extending from beneath the wall 80 of the receptacle 44, first upwardly and then laterally for passing through the tubular member side wall gap 52 and over the laterally spaced wall section 58. The wires are thus not pinched between the receptacle side wall 80 and the tubular member side wall 60, but pass relatively freely and without excessively sharp bends through the exit port defined by the interfitting receptacle wall 80 and the tubular wall 58.

Beyond the tubular member 46, the wires 54 pass freely through a relatively large opening 116 through the connector assembly base plate 42.

The assembly (by hand) of the connector assembly 40 is now described; the assembly of the terminal wires 56 within the receptacle 44 having been previously described.

For preparing mounting of the receptacle 44 within the tubular member 46, the wires 54 (FIG. 2) extending from the bottom end 73 of the receptacle wall section 70 are bent laterally across the bottom of the receptacle and outwardly through the gap 112 through the receptacle side wall 80. The extending wires 54 are then threaded through the opening 116 of the base plate 42 of the connector assembly 40. The receptacle 44, with the wires 54 extending therefrom threaded loosely through the base plate opening 116, is aligned with the open top end of the tubular member 46 and telescoped therewithin. As previously noted, the receptacle laterally extending portion 70 fits within the tubular member channel portion 68 for guiding the receptacle 44 into the tubular member 46 until the latches 76 at the upper ends 78 of the receptacle leaf springs 74 snap into place within openings 120 through the walls 48 of the tubular member 46 adjacent to the upper end thereof.

As the receptacle is moved downwardly into the tubular member, the wires 54 extending from beneath the receptacle, via the gap 112 through the receptacle wall 80, are aligned with and extend through the exit gap 52 through the tubular member side wall 50. When the receptacle 44 is fully seated within the tubular member 46 [and resting (FIG. 8) on the tubular member bottom wall ridges 43], the receptacle side wall 80 is disposed across the exit gap 52 in the tubular member side wall 50 thus "closing" the exit gap 52. While the exit gap is thus "closed" in the sense that no single straight line path extends from outside the tubular member to within the cavity of the receptacle, the wires 54 pass loosely through the exit gap 52 which is relatively open for the passage therethrough of low viscosity fluids.

Figure 9:
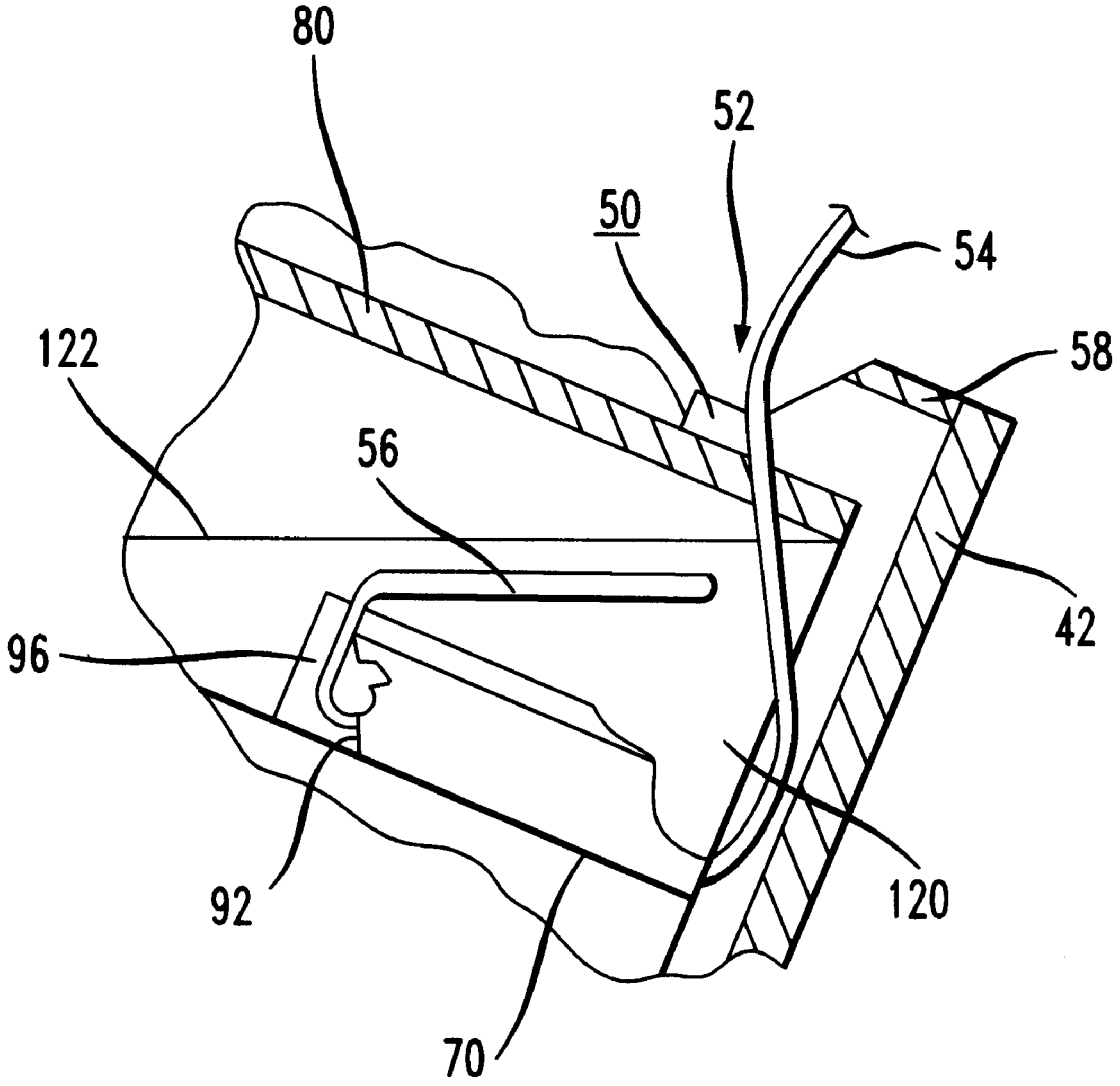
FIG. 9 is a view similar to FIG. 8 but showing the interior of the receptacle cavity and with the entire assembly tilted from the vertical position of the assembly shown in FIG. 8.

Two low viscosity fluids (components of a final, high viscosity silicone gel) are now poured into the receptacle through the open upper end to form a sealant pool 120 (FIG. 9) and, for this purpose, the connector assembly is first tilted to an orientation where (as shown in FIG. 9) the two co-planar terminals 56 within the receptacle are disposed horizontally. The horizontal orientation of the two terminals 56 accomplishes two purposes related to the location of the surface 122 of the now provided sealant pool 120 within the receptacle cavity.

The pool 120 fully immerses the exposed terminals 56 within the receptacle and along the shelf 92. However, owing to the tilted orientation of the receptacle, the surface 122 of the pool extends diagonally across the receptacle and only partially fills it. This reduces the amount of sealant fluid necessary to fully immerse the otherwise exposed terminals 56 within the receptacle.

Additionally, because of the tilted orientation of the receptacle, the level of the pool surface 122 is below the gap 52 through the tubular member side wall 50. Accordingly, the low viscosity sealant fluids do not flow outwardly of the gap 52 (through which the wires 54 enter the receptacle assembly), and sealing of the gap 52 is not required (in comparison with the need for sealing the wire admitting opening 20 of the prior art connector assembly 10 shown in FIG. 1).

The tilt of the connector assembly is maintained until the sealant fluid sets-up or cures to a high viscosity condition. Thereafter, regardless of the orientation of the connector assembly, the sealant gel remains within the receptacle cavity and remains adhered to the terminals 56 owing to the high surface tension of the sealant gel. With time, with the connector assembly in horizontal orientation, the sealant gel enters and effectively seals the exit opening 52 while not flowing outwardly therefrom.

Different sealant fluids, such as commonly used in prior art connector assemblies, can be used in accordance with this invention provided they have sufficiently high viscosity to remain in place within the receptacle. The preferred sealant can comprise any of a number silicon gels manufactured by such chemical companies as General Electric, Dow Corning and the like. Other sealants such as grease can be used.

The connector assembly 40, when completed and filled with a sealant fluid, can then be used similarly as the prior art connector assembly previously described. A known type of connector plug 30 (FIG. 1) can be inserted into the cavity of the receptacle with the plug exposed terminal edges engaged with the terminals 56 within the receptacle. As the plug is pressed inwardly of the receptacle, the receptacle terminals are pressed inwardly of their channels and pressed against the channel bottom surfaces for firm electrical contacting between the plug flange terminals and the receptacle terminals 56. When fully inserted, the plug rests on the horizontal plates 102 of the receptacle.

What is claimed is:

1. A method of fabricating a connector receptacle of the type comprising a bottom wall surrounded by side walls generally perpendicular thereto, said receptacle including a cavity and one of said side walls having a port therethrough admitting a wire for entry into said cavity, the wire within said cavity projecting from a cavity wall downwardly and away from said cavity wall and in a direction, if extended, to intersect said bottom wall at a point laterally spaced from said side wall port, the method comprising the steps of orienting the receptacle with the cavity therein opening generally upwardly and with the projecting direction of the wire within said cavity being parallel to a horizontal direction, and dispensing a fluid into said cavity for forming a pool having a surface covering said horizontally disposed wire and having a pool edge disposed beneath said side wall port for preventing leakage of said fluid through said port.

2. A method according to claim 1 including dispensing two fluid components of a silicone gel into said cavity for forming said pool, and maintaining the said orientation of said receptacle until said fluid components interact to form a gel of sufficiently high viscosity and surface tension for preventing gravity induced flow of the gel through said port.

3. A connector assembly comprising a tubular member having a side wall encircling a closed bottom and an open top end, a port through said side wall for passage of a wire, and a tubular receptacle for receipt within said tubular member, said receptacle having open top and bottom surfaces with said bottom surface overlying the bottom end of said tubular member when received therewithin, said wire extending upwardly along a wall of said receptacle and terminating in a wire end projecting from said receptacle wall in a direction downwardly within the interior of said receptacle and away from said receptacle wall and intersecting the bottom surface of said receptacle but terminating short thereof.

4. A connector assembly according to claim 3 wherein said wire passing into said tubular member wall port first passes beneath said receptacle and over said bottom wall of said tubular member and thence upwardly along said receptacle.

5. A connector assembly according to claim 4 wherein said wire passes upwardly through a passageway extending vertically along said receptacle side wall, and said wire projects into said receptacle from an upper, wire exiting end, of said passageway.

6. A connector assembly according to claim 5 including a sealant fluid within said receptacle encapsulating said wire therewithin and sealing said passageway wire exiting end.

* * * * *